US007984634B2

(12) United States Patent
Marti et al.

(10) Patent No.: US 7,984,634 B2
(45) Date of Patent: Jul. 26, 2011

(54) MILLING DEVICE FOR INLINE ROLLING A STEEL BAND PRODUCED ESPECIALLY BY MEANS OF A TWIN-ROLL CONTINUOUS CASTING PROCESS

(75) Inventors: Heinrich Marti, Forch (CH); John Turley, Oxford, CT (US)

(73) Assignee: Main Management Inspiration AG, Hergiswil (CH)

( * ) Notice: Subject to any disclaimer, the term of this patent is extended or adjusted under 35 U.S.C. 154(b) by 682 days.

(21) Appl. No.: 11/884,697

(22) PCT Filed: Feb. 23, 2006

(86) PCT No.: PCT/EP2006/001675

§ 371 (c)(1),
(2), (4) Date: May 8, 2008

(87) PCT Pub. No.: WO2006/089755

PCT Pub. Date: Aug. 31, 2006

(65) Prior Publication Data

US 2008/0276680 A1 Nov. 13, 2008

(30) Foreign Application Priority Data

Feb. 23, 2005 (CH) ..... 0333/05

(51) Int. Cl.
*B21B 31/07* (2006.01)

(52) U.S. Cl. ..... 72/237; 72/38; 72/245; 72/248; 72/251; 29/527.7

(58) Field of Classification Search ..... 72/38, 201, 72/206, 226, 234, 237, 238, 248, 250, 251, 72/245; 29/527.7
See application file for complete search history.

(56) References Cited

U.S. PATENT DOCUMENTS

| | | | | | |
|---|---|---|---|---|---|
| 3,310,971 | A | * | 3/1967 | Tanaka et al. | 72/9.5 |
| 3,333,452 | A | * | 8/1967 | Sendzimir | 72/184 |
| 3,693,393 | A | * | 9/1972 | Nellen et al. | 72/226 |
| 3,786,664 | A | * | 1/1974 | Jones et al. | 72/234 |
| 4,580,428 | A | * | 4/1986 | Brettbacher et al. | 72/226 |
| 4,958,677 | A | * | 9/1990 | Kimura | 164/452 |
| 5,634,257 | A | * | 6/1997 | Kajiwara et al. | 29/527.7 |
| 5,857,372 | A | * | 1/1999 | Sendzimir et al. | 72/237 |
| 6,286,354 | B1 | * | 9/2001 | Kajiwara et al. | 72/237 |
| 6,655,184 | B2 | * | 12/2003 | Meaney et al. | 72/196 |
| 7,152,661 | B2 | * | 12/2006 | Flemming et al. | 164/477 |

FOREIGN PATENT DOCUMENTS

| | | | |
|---|---|---|---|
| DE | 1527631 | * | 1/1970 |
| JP | 59-127907 | * | 7/1984 |
| JP | 9-164405 | * | 6/1997 |

* cited by examiner

*Primary Examiner* — Edward Tolan
(74) *Attorney, Agent, or Firm* — Brian Roffe

(57) ABSTRACT

Disclosed is a milling device for inline-rolling a steel band which is produced especially by means of a twin-roll continuous casting process. Said milling device comprises at least two rolling units (20, 30) with working rolls (21, 31) that mill the steel band (11) and support rolls (22, 32) which support said working rolls. The working rolls and support rolls are rotatably mounted in bearing housings (23, 24, 33, 34). At least two rolling units (20, 30) are disposed successively in a monolithic or multipiece frame structure (15) such that the rolling temperatures between the rolling units differ only slightly while a simple and inexpensive design is created.

20 Claims, 3 Drawing Sheets

10
36
36
14
15
17
37
37
20'
30'
23
33
22
32
20
30
21
31
12
11
13
18
21
31
22
32
24
34
37
39
39
19

MILLING DEVICE FOR INLINE ROLLING A STEEL BAND PRODUCED ESPECIALLY BY MEANS OF A TWIN-ROLL CONTINUOUS CASTING PROCESS

This application is a 35 USC 371 of PCT/EP/001675, filed Feb. 23, 2006.

The invention concerns a milling device for inline rolling a steel band, produced especially by means of a twin-roll continuous casting process, which has at least two rolling units with working rolls to mill the steel band and support rolls, rotatably mounted in bearing housings.

In continuous casting processes of prior art, in particular twin-roll continuous casting or belt casting, by comparison with ordinary thin-slab casting, it is easy to cast thinner bands in the range of 0.5 to a few millimetres thick. This means it is no longer necessary to rough down the cast bands many times over using hot rolling mills or separate cold rolling mills, for example in the case of sheets which must be manufactured to a few tenths of a millimetre thick.

This inline-rolling process can be applied through continuous casting, in which the cast bands can be rolled immediately after casting while still in hot condition at temperatures of approx. 900°-1200° C., which represents a very efficient method.

Earlier hot rolling mills are of very bulky construction, and as a result relatively large distances, of up to a few metres, arise between the individual units. This gave rise to the problem that excessive temperature losses occurred between the units.

In comparison with ordinary rolling mills, the belt speeds used in inline-rolling of the cast band are several times smaller, instead of approx. 20 m/s only approx. 0.5 to 2.0 m/s. As in the case of ordinary rolling mills, the rolling forces are very high, so the rolling devices have to be of correspondingly stable construction.

For this reason, the invention was based on the problem of creating a rolling device which is of simple and economical construction and by means of which the cast steel band is rolled at the optimal moment.

This problem is solved according to the invention by the fact that at least two rolling units are arranged directly in series in a single- or multiple-part frame construction.

This inventive design of a rolling device guarantees that the roller temperatures between the rolling units vary only slightly and therefore the steel band need not be warmed up for rolling, and the working rolls enable consistent roughing down, even under heavy loads, within the necessary tolerances. This is solved according to the invention by a simple and economical construction.

The invention also makes provision for the working rolls to be changed without having to stop the rolling, i.e. that they can more or less be changed on the fly.

Figure 1:
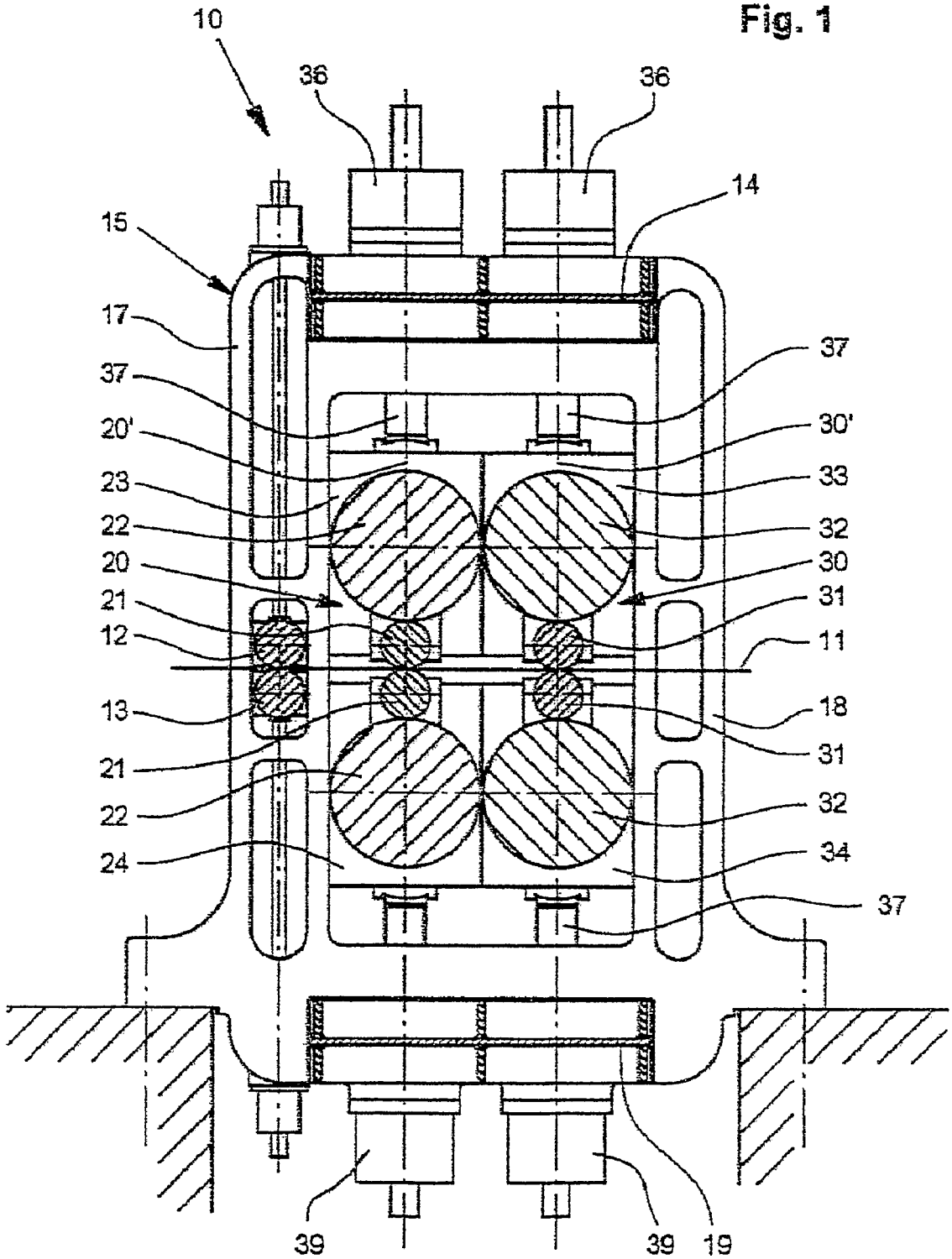
Figure 2:
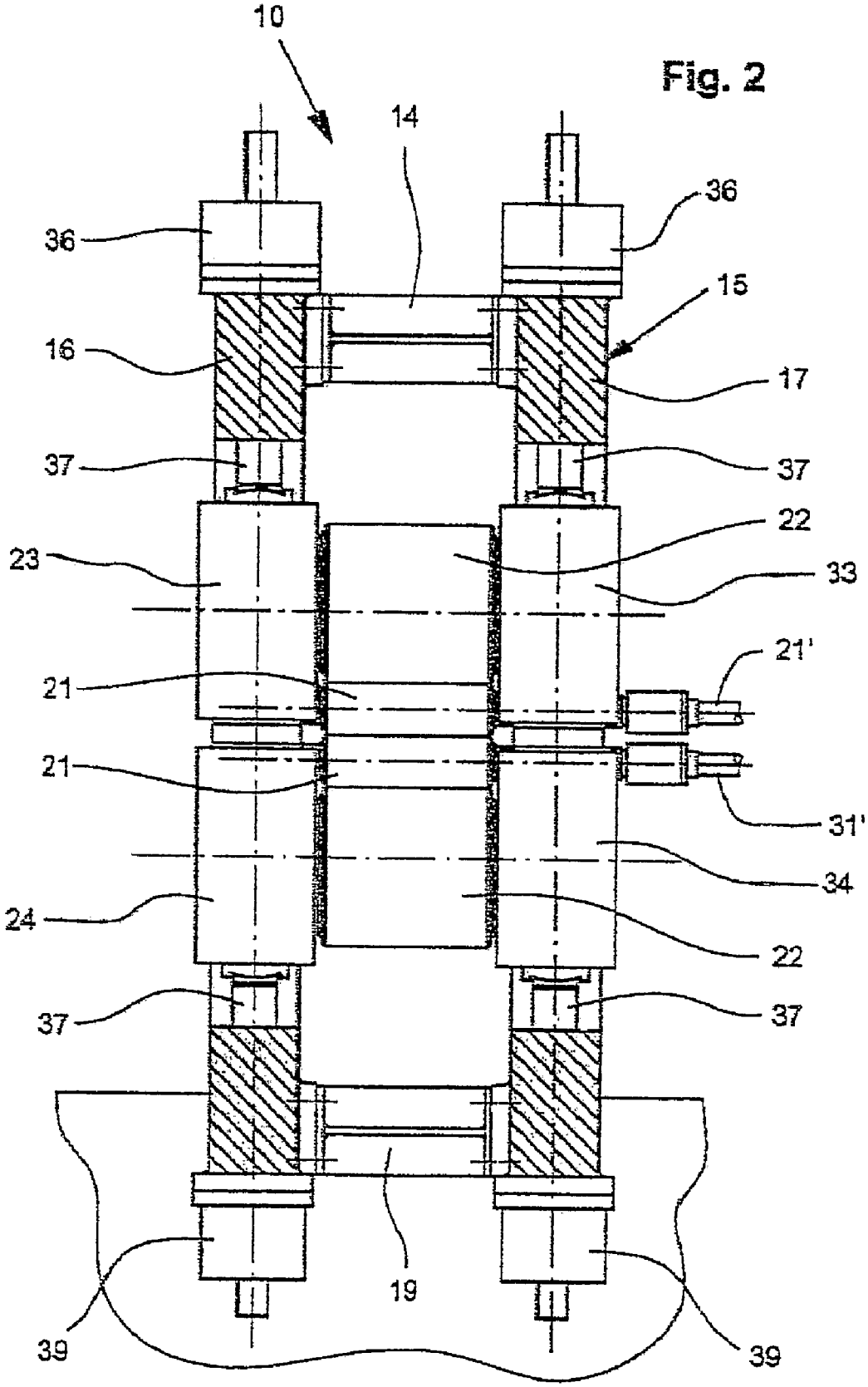

One embodiment of the invention and further advantages thereof are next explained in more detail with the aid of the drawings, which show:

FIG. 1 an inventive rolling device in schematic later view,

FIG. 2 a frontal view of the rolling device according to FIG. 1, and

Figure 3:
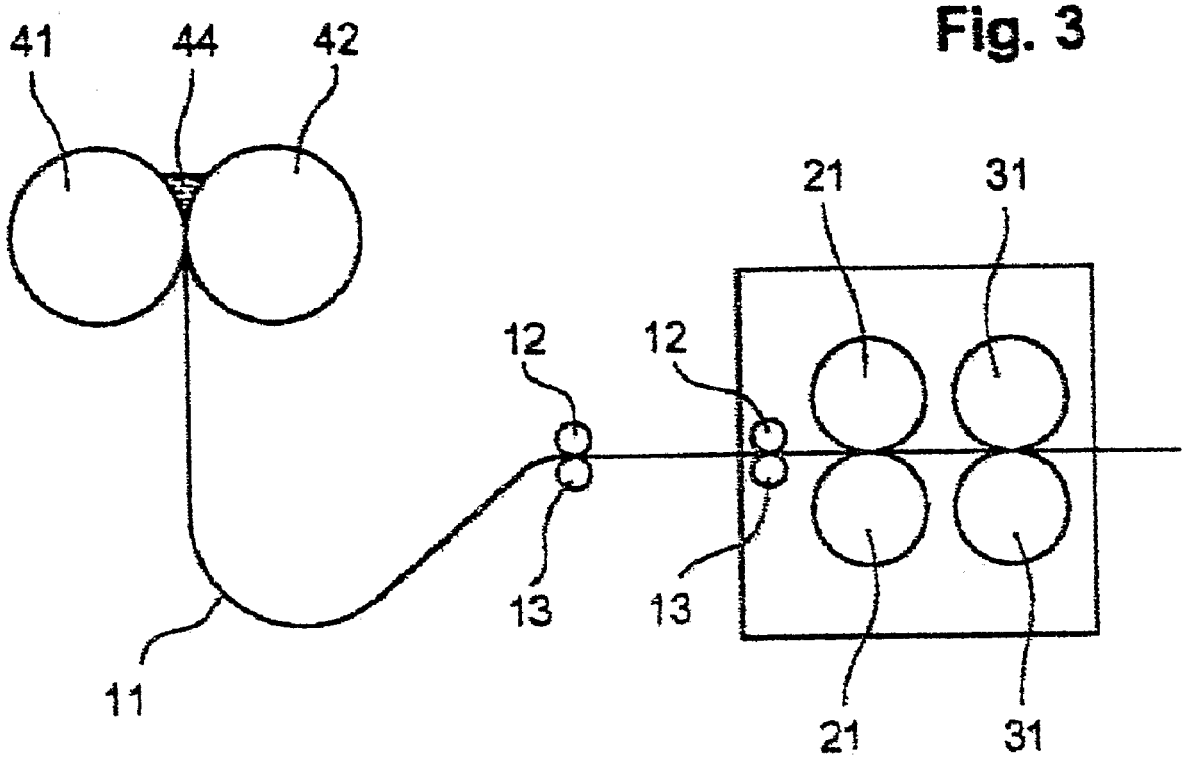

FIG. 3 a schematic view of a casting plant with the rolling device.

FIG. 1 and FIG. 2 show a rolling device 10 for inline-rolling a steel band 11 produced especially by means of a twin-roll continuous casting process, as can also be seen from FIG. 3. This rolling device 10 is arranged at such a distance from the casting rolls 41, 42 producing the steel band 11 that the steel band 11 is sufficiently cooled down. It would also be possible to cool the steel band 11 further by cooling panels, not shown in more detail, prior to entering the rolling device 10. These cooling panels would be controllable in such a way that the inlet temperature of the steel band can be adjusted to a selectable temperature which is as constant as possible over the width.

Two rolling units 20 and 30 are provided, which each have a working roll 21, 31 situated above and below the steel band 11 and each have a support roll 22, 32 rotatably connected with this working roll 21, 31. These working rolls 21, 31 and support rolls 22, 32 are advantageously located with their axes of rotation on a plane 20', 30' running perpendicular to the extension of the steel band 11. The working rolls 21, 31 can be coupled with the indicated drive shafts 21', 31' of a driving member. In principle, either the support rolls or both working and support rolls could be driven.

According to the invention, the two rolling units 20, 30 are arranged directly in series in a frame construction 15. This produces the advantage that firstly the steel band 11 only cools down slightly from one working roll 21, 31 to the next. Also, with this arrangement of the rolling device, very little space is required by comparison with ordinary rolling mills and this produces substantial cost savings.

The frame construction 15 is formed from four vertical columns 16, 17, 18 arranged at a distance from each other and cross-pieces 14, 19 connecting them. They could, however, also be designed as a housing or as a housing-type frame, so as to enclose the rolls. This would be especially suitable if the steel band were to be held in an inerting chamber provided inside the frame housing.

A respective support roll 22, 32 is rotatably mounted together with the working roll 21, 31 rotatably connected to it on both sides in a bearing housing 23, 24, 33, 34. In this case, two bearing housings 23, 33 each are provided, above and below, which are height-adjustable by means of a driving pillar 37 with a drive 36 fixed on the upper crosspiece 14 of the frame construction 15, for example an electromechanical or a hydraulic spindle drive, in this plane 20', 30' running perpendicular to the extension of the steel band 11.

Similarly, the lower rolls 21, 22, 31, 32 are rotatably mounted on both sides in a bearing housing 24, 34, whereby these bearing housings 24, 34 in turn are coupled to a drive 39 fixed to a drive pillar 37 fixed onto the crosspiece 19 of the frame construction 15.

The upper and lower bearing housings 23, 24, 33, 34 respectively are guided internally directly against each other and externally against a pillar 17, 18. Advantageously, there are gauge heads, not shown in more detail, arranged between these bearing housings 23, 33 and 24, 34 respectively, which measure and analyse the horizontal force acting in the direction of the steel band 11 between these bearing housings, such that if a specified horizontal force is exceeded, the speed of the working rolls 21, 31 is adjusted from one rolling unit 20, 30 to the next, in order to reduce this horizontal force to zero or a specified horizontal force.

Due to the design of the upper and lower working rolls 22, 32 and 21, 31 respectively, which can be raised and lowered by means of the drives 36, 39, these rolls can be changed during casting, i.e. without stopping casting. This can be done in such a way that first the front rolling unit 20 and then the rear rolling unit 30 can be exchanged, in which case advantageously during the change of one pair of working rolls 21, 31 the other roll pair 31, 21 can reduce the cast strip 11 by the total amount as if both roll pairs were rolling.

Furthermore, there is also provided an inlet roll pair 12, 13, also mounted in the frame construction 15, and additionally connected in series with the rolling units 20, 30. This inlet roll pair 12, 13 serves to guide the steel band 11 perfectly smoothly, in particular when the working rolls are being changed.

Within the scope of the invention, the working rolls 21, 31 can be arranged displaceably in order to achieve consistent wear in their axial direction, which is not shown in more detail. Preferably, both working rolls 21, 31 are arranged so as to be displaceable in the same direction.

FIG. 3 shows in a schematic view the casting rolls 41, 42 which are rotatable during casting, the melting bath 44 between these and the steel band 11 produced, which is diverted from a vertical into a horizontal position, forming a loop, and is guided through guide rolls 12', 13', the inlet rolls 12, 13 and through the working rolls 21, 31. The speed of the driven working rolls 21 of the rolling unit 20 to come into first contact with the steel band 11 is made to depend on the speed of the casting rolls 41, 42, while the speed of the following driven working rolls 31 occurs as a function of the speed of the series-connected working rolls 21. In this way, a co-ordinated control of the speeds and thus a rolling of the steel band 11 can be achieved without the steel band 11 becoming overstretched or too loose between the working roll pairs 21, 31.

The invention is sufficiently explained with the above embodiment. In principle, instead of a frame construction as shown, a housing frame or a housing-type frame could also be used.

It would also be possible to arrange more than two rolling units side by side in a frame construction. In principle, guide rails forming part of the frame construction could also be provided between the bearing housings.

Nor does the invention rule out the possibility that also two or more such rolling devices could be arranged one behind the other.

The arrangement of the working and support rolls of a rolling unit can be selected from a so-called 4-Hi (as shown), a 6-Hi or a Z-Hi.

The invention claimed is:

1. Rolling device for inline-rolling a steel band, which has at least two rolling units (20, 30) with working rolls (21, 31) to mill the steel band (11) and support rolls (22, 32), rotatably mounted in bearing housings (23, 24, 33, 34), wherein each of the two rolling units (20, 30) comprises upper and lower working rolls (21, 31) located above and below, respectively, a space through which the steel band (11) passes and upper and lower support rolls (22, 32) rotatably connected with the upper and lower working rolls respectively, the working and support rolls in each of the two rolling units being located with their axes of rotation in a respective, common plane (20', 30') running perpendicular to an extension of the steel band (11), further comprising:

a frame construction (15) in which the at least two rolling units (20, 30) are arranged directly in series;

bearing housings (23, 24, 33, 34), each working roll (21, 31) and the support roll (22, 32) rotatably connected thereto being rotatably mounted on each side in a respective one of the bearing housings (23, 24, 33, 34); and drive systems that adjust a height of the bearing housings (23, 24, 33, 34) such that each working roll (21, 31) and the support roll (22, 32) rotatably connected thereto and rotatably mounted on each bearing housing (23, 24, 33, 34) are moved together by the drive system that adjusts that bearing housing (23, 24, 33, 34).

2. Rolling device according to claim 1, wherein each of the drive systems that provide height adjustment of the bearing housings includes a hydraulically controlled spindle drive.

3. Rolling device according to claim 1, wherein upper and lower ones of the bearing housings (23, 24, 33, 34) of the rolling units (20, 30) are guided against each other and a horizontal force acting in the direction of the steel band between these bearing housings (23, 24, 33, 34) is measured and analyzed such that if a specified horizontal force is exceeded, a speed of the working rolls (22, 32) is adjusted from one rolling unit (20, 30) to the next in order to reduce this horizontal force to zero or a specified horizontal force.

4. Rolling device according to claim 2, wherein the frame construction (15) consists of four pillars (16, 17, 18) arranged at a distance from each other and crosspieces (14, 19) connecting the four pillars (16, 17, 18), while the height of the bearing housings (23, 24, 33, 34) is controlled in pairs between two pillars (16, 17, 18).

5. Rolling device according to claim 1, further comprising an inlet roll pair (12, 13) provided in series with the rolling units (20, 30).

6. Rolling device according to claim 1, wherein the steel band (11) passing through the rolling units (20, 30) is screened by an inerting protective gas.

7. Rolling device according to claim 1, wherein the working rolls (21, 31) of one of the two rolling units (20, 30) are arranged to be replaceable during casting.

8. Rolling device according to claim 1, wherein the working rolls (21, 31) are arranged to be displaceable in their axial direction in order to achieve consistent wear.

9. Rolling device according to claim 1, wherein the frame construction (15) is designed as a housing or a housing-type frame.

10. Rolling device according to claim 1, wherein a speed of a first pair of the working rolls (21) to come into contact with the steel band (11) occurs as a function of a speed of casting rolls and a speed of a following pair of working rolls (31) occurs as a function of the speed of the first working roll pair (21) connected in series.

11. Rolling device according to claim 1, wherein several such frame constructions (15) each with at least two rolling units (20, 30) are arranged in series.

12. Rolling device according to claim 1, wherein the frame construction (15) is made of one part.

13. Rolling device according to claim 1, wherein the frame construction (15) is made of more than one part.

14. Rolling device according to claim 1, wherein the rolling device is arranged to produce the steel band (11) by means of a twin-roll continuous casting process.

15. Rolling device according to claim 1, wherein at least one of the drive systems is a hydraulically controlled spindle drive.

16. Rolling device according to claim 1, wherein the bearing housings (23, 24, 33, 34) in each of the rolling units (20, 30) are adjustable by the drive systems independent of adjustment of the bearing housings (23, 24, 33, 34) in the other rolling unit (20, 30).

17. Rolling device according to claim 1, wherein the bearing housings (23, 24, 33, 34) are arranged such that the working rolls (21, 31) in each of the rolling units (20, 30) are movable away from the steel band (11) via movement of the bearing housings (23, 24, 33, 34) to which the working rolls (21, 31) are rotatably mounted while the working rolls (21, 31) in the other of the rolling units (20, 30) is maintained in contact with the steel band (11).

18. Rolling device according to claim 1, wherein the drive systems are arranged such that each drive system adjusts a height of a respective one of the bearing housings (23, 24, 33, 34).

19. Rolling device according to claim 5, wherein the inlet roll pair (12, 13) is mounted in the frame construction (15).

20. Rolling device according to claim 8, wherein both working rolls (21, 31) are arranged to be displaceable in the same direction.

* * * * *